US009328596B2

(12) United States Patent
Fischer et al.

(10) Patent No.: US 9,328,596 B2
(45) Date of Patent: May 3, 2016

(54) HEATER AND METHOD OF OPERATING

(71) Applicant: DELPHI TECHNOLOGIES, INC., Troy, MI (US)

(72) Inventors: Bernhard A. Fischer, Honeoye Falls, NY (US); James D. Richards, Spencerport, NY (US); Arun Iyer Venkiteswaran, Bangalore (IN)

(73) Assignee: Delphi Technologies, Inc., Troy, MI (US)

( * ) Notice: Subject to any disclaimer, the term of this patent is extended or adjusted under 35 U.S.C. 154(b) by 46 days.

(21) Appl. No.: 14/159,585

(22) Filed: Jan. 21, 2014

(65) Prior Publication Data

US 2015/0204172 A1 Jul. 23, 2015

(51) Int. Cl.

| | |
|---|---|
| ***E21B 43/243*** | (2006.01) |
| ***E21B 36/04*** | (2006.01) |
| ***E21B 36/00*** | (2006.01) |

(52) U.S. Cl.

CPC ..... *E21B 43/243* (2013.01); *E21B 36/008* (2013.01); *E21B 36/04* (2013.01)

(58) Field of Classification Search

CPC ... E21B 43/243; E21B 43/24; E21B 43/2401; E21B 43/30; E21B 36/04; E21B 17/028; C09K 8/592; Y10S 48/06; H01M 8/249; H01M 8/24; H01M 8/2465

See application file for complete search history.

(56) References Cited

U.S. PATENT DOCUMENTS

| | | | | |
|---|---|---|---|---|
| 6,684,948 | B1 | 2/2004 | Savage | |
| 6,720,099 | B1 | 4/2004 | Haltiner, Jr. | |
| 7,182,132 | B2 | 2/2007 | Savage | |
| 2001/0049039 | A1 | 12/2001 | Haltiner, Jr. | |
| 2004/0200605 | A1 | 10/2004 | Yoshida et al. | |
| 2004/0229096 | A1 | 11/2004 | Standke et al. | |
| 2006/0147771 | A1 | 7/2006 | Russell et al. | |
| 2007/0048685 | A1 | 3/2007 | Kuenzler et al. | |
| 2010/0163226 | A1 | 7/2010 | Zornes | |
| 2012/0094201 | A1 | 4/2012 | Haltiner, Jr. et al. | |
| 2015/0162637 | A1 * | 6/2015 | Ricci-Ottati et al. | H01M 8/249 |

OTHER PUBLICATIONS

"Phase 1 Report, Geothermic Fuel Cell In-Situ Applications for Recovery of Unconventional Hydrocarbons"; Independent Energy Partners; Title: Geothermic Fuel Cells: Phase 1 Report, 2010.

* cited by examiner

*Primary Examiner* — Zakiya W Bates
(74) *Attorney, Agent, or Firm* — Thomas N. Twomey

(57) ABSTRACT

A plurality of heaters are disposed end to end within a bore hole of a formation where the bore hole extends from an upper end to a lower end such that a lower heater of the plurality of heaters is proximal to the lower end of the bore hole while every other of the plurality of heaters is distal from the lower end of the bore hole. Each of the plurality of heaters includes a fuel cell stack assembly having a plurality of fuel cells which convert chemical energy from a fuel into heat and electricity through a chemical reaction with an oxidizing agent. Each of the plurality of heaters has a thermal output that is less than or equal to a predetermined value except the lower heater of the plurality of heaters which has a thermal output that is greater than the predetermined value.

9 Claims, 5 Drawing Sheets

HEATER AND METHOD OF OPERATING

TECHNICAL FIELD OF INVENTION

The present invention relates to a heater which uses fuel cell stack assemblies as a source of heat; more particularly to such a heater which is positioned within a bore hole of an oil containing geological formation in order to liberate oil therefrom; and even more particularly to such a heater which uses a supplemental heater to lower the heat loss of the lower-most fuel cell stack assembly in the bore hole.

BACKGROUND OF INVENTION

Subterranean heaters have been used to heat subterranean geological formations in oil production, remediation of contaminated soils, accelerating digestion of landfills, thawing of permafrost, gasification of coal, as well as other uses. Some examples of subterranean heater arrangements include placing and operating electrical resistance heaters, microwave electrodes, gas-fired heaters or catalytic heaters in a bore hole of the formation to be heated. Other examples of subterranean heater arrangements include circulating hot gases or liquids through the formation to be heated, whereby the hot gases or liquids have been heated by a burner located on the surface of the earth. While these examples may be effective for heating the subterranean geological formation, they may be energy intensive to operate.

U.S. Pat. Nos. 6,684,948 and 7,182,132 to Savage propose subterranean heaters which use fuel cells as a more energy efficient source of heat. The fuel cells are disposed in a heater housing which is positioned within the bore hole of the formation to be heated. The fuel cells convert chemical energy from a fuel into heat and electricity through a chemical reaction with an oxidizing agent. If the temperature of a fuel cell falls below a predetermined temperature, for example about 680° C. in some types of fuel cells, a temperature gradient and voltage drop may result which can challenge the operability and life of the fuel cell. Fuel cells that are not located at the bottom of the bore hole are subject to heat from fuel cells that are lower in the bore hole due to heat naturally rising upward through the bore hole. This heat from fuel cells that are lower in the bore hole help to keep the fuel cells that are not located at the bottom of the bore hole above the predetermined temperature. However, the fuel cells that are located at the bottom of the bore hole do not receive additional heat, and are consequently subject to additional heat loss which may allow the fuel cells to drop below the predetermined temperature.

What is needed is a heater which minimizes or eliminates one of more of the shortcomings as set forth above.

SUMMARY OF THE INVENTION

Briefly described, a plurality of heaters is provided to be disposed end to end within a bore hole of a formation where the bore hole extends from an upper end to a lower end such that a lower heater of the plurality of heaters is proximal to the lower end of the bore hole while every other of the plurality of heaters is distal from the lower end of the bore hole. Each of the plurality of heaters includes a fuel cell stack assembly having a plurality of fuel cells which convert chemical energy from a fuel into heat and electricity through a chemical reaction with an oxidizing agent. Each of the plurality of heaters has a thermal output that is less than or equal to a predetermined value except the lower heater of the plurality of heaters which has a thermal output that is greater than the predetermined value.

BRIEF DESCRIPTION OF DRAWINGS

This invention will be further described with reference to the accompanying drawings in which.

DETAILED DESCRIPTION OF INVENTION

Figure 1:
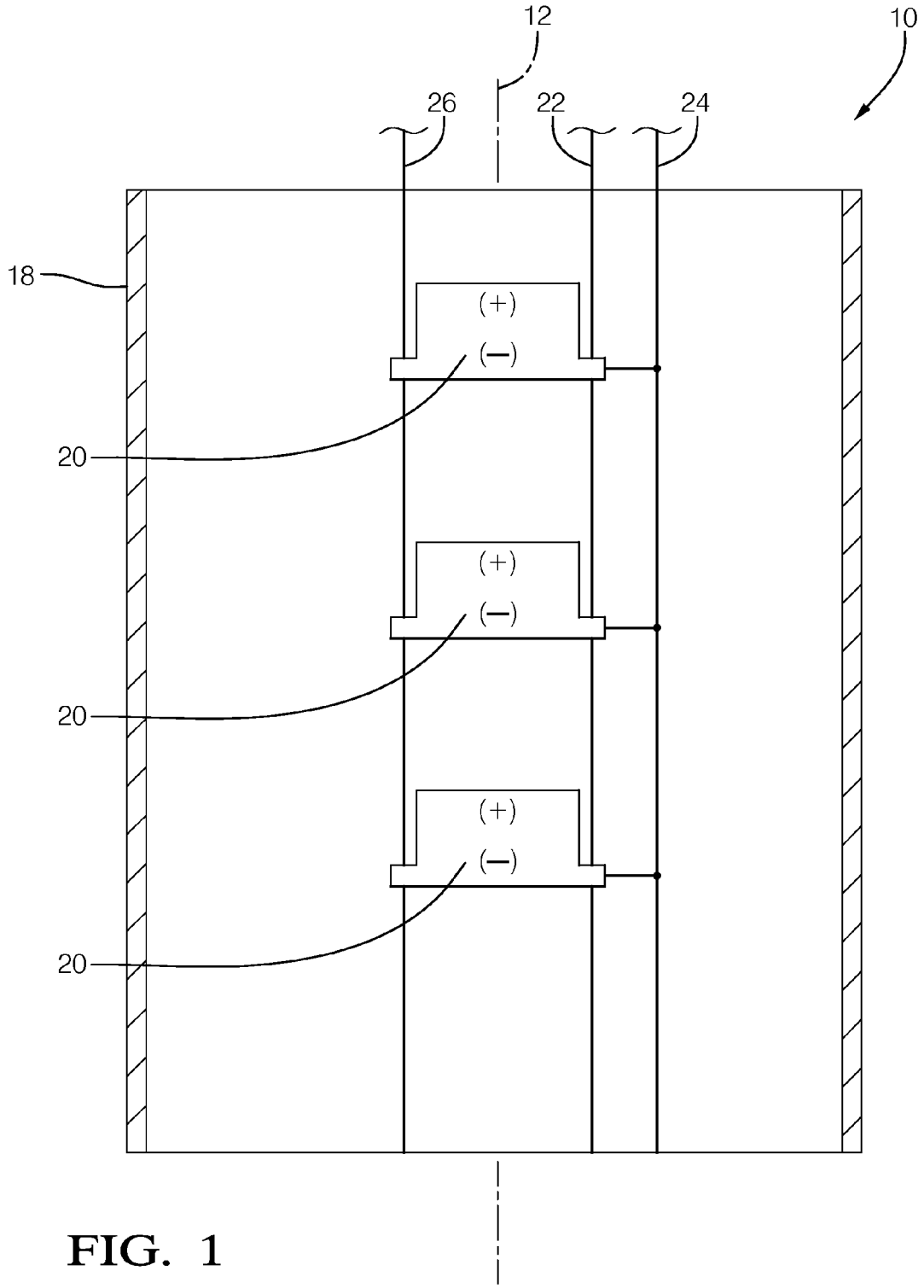
FIG. 1 is a cross-section schematic view of a heater in accordance with the present invention.

Referring now to the drawings wherein like reference numerals are used to identify identical components in the various views, reference will first be made to FIGS. 1 and 2 where a heater 10 extending along a heater axis 12 is shown in accordance with the present invention. A plurality of heaters $\mathbf{10}_1, \mathbf{10}_2, \ldots \mathbf{10}_{n-1}, \mathbf{10}_n$, where n is the total number of heaters 10, may be connected together end to end within a bore hole 14 of a formation 16, for example, an oil containing geological formation, as shown in FIG. 2. Bore hole 14 extends from an upper end 14*a* to a lower end 14*b* such that heater $\mathbf{10}_n$ is a lower heater that is proximal to lower end 14*b* while the remaining heaters $\mathbf{10}_1, \mathbf{10}_2, \ldots \mathbf{10}_{-1}$ are distal from lower end 14*b*. Bore hole 14 may be only a few feet deep; however, may typically be several hundred feet deep to in excess of one thousand feet deep. Consequently, the number of heaters 10 needed may range from 1 to several hundred. It should be noted that the oil containing geological formation may begin as deep as one thousand feet below the surface and consequently, heater $\mathbf{10}_1$ may be located sufficiently deep within bore hole 14 to be positioned near the beginning of the oil containing geological formation. When this is the case, units without active heating components may be positioned from the surface to heater $\mathbf{10}_1$ in order to provide plumbing, power leads, and instrumentation leads to support and supply fuel and air to heaters $\mathbf{10}_1$ to $\mathbf{10}_n$.

Heater 10 generally includes a heater housing 18 extending along heater axis 12, a plurality of fuel cell stack assemblies 20 located within heater housing 18 for generating heat and electricity such that each fuel cell stack assembly 20 is spaced axially apart from each other fuel cell stack assembly 20, a fuel supply conduit 22 for supplying fuel to fuel cell stack assemblies 20, an oxidizing agent supply conduit 24; hereinafter referred to as air supply conduit 24; for supplying an oxidizing agent, for example air, to fuel cell stack assemblies 20, and an anode exhaust conduit 26 for discharging anode exhaust from fuel cell stack assemblies 20. While heater 10 is illustrated with three fuel cell stack assemblies 20 within heater housing 18, it should be understood that a lesser number or a greater number of fuel cell stack assemblies 20 may be included. The number of fuel cell stack assemblies 20 within heater housing 18 may be determined, for example only, by one or more of the following considerations: the length of heater housing 18, the heat output capacity of each fuel cell stack assembly 20, the desired density of fuel cell stack assemblies 20 (i.e. the number of fuel cell stack assemblies 20 per unit of length), and the desired heat output of heater 10. The number of heaters 10 within bore hole 14 may be determined, for example only, by one or more of the following considerations: the depth of formation 16 which is desired to be heated, the location of oil within formation 16, and the length of each heater 10.

Heater housing 18 may be substantially cylindrical and hollow and may support fuel cell stack assemblies 20 within heater housing 18. Heater housing 18 of heater $\mathbf{10}_x$, where x is from 1 to n where n is the number of heaters 10 within bore hole 14, may support heaters $\mathbf{10}_{x+1}$ to $\mathbf{10}_n$ by heaters $\mathbf{10}_{x+1}$ to $\mathbf{10}_n$ hanging from heater $\mathbf{10}_x$. Consequently, heater housing 18 may be made of a material that is substantially strong to accommodate the weight of fuel cell stack assemblies 20 and heaters $\mathbf{10}_{x+1}$ to $\mathbf{10}_n$. The material of heater housing 18 may also have properties to withstand the elevated temperatures, for example 600° C. to 900° C., as a result of the operation of fuel cell stack assemblies 20. For example only, heater housing 18 may be made of a 300 series stainless steel with a wall thickness of 3/16 of an inch.

Figure 2:
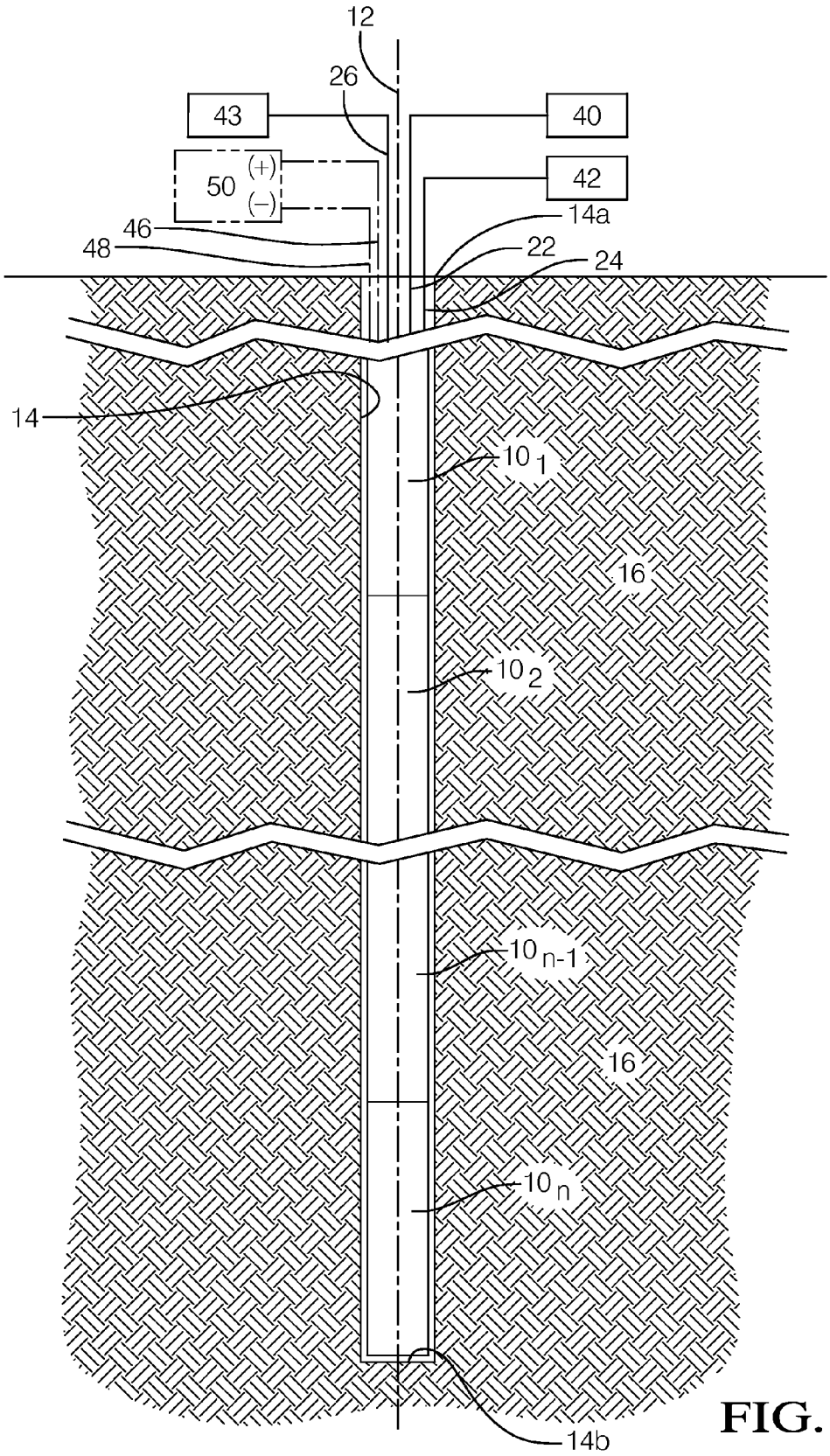
FIG. 2 is a schematic view of a plurality of heaters of FIG. 1 shown in a bore hole of a geological formation.
Figure 3:
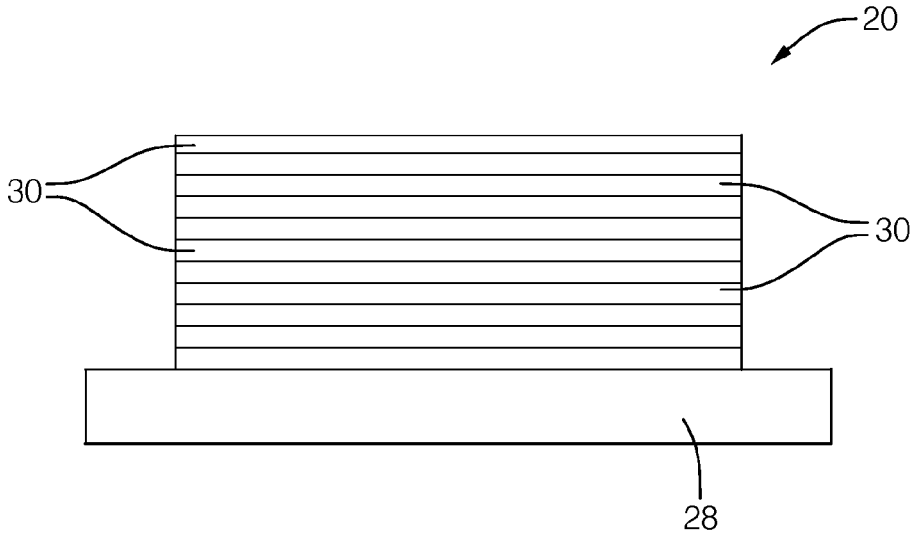
FIG. 3 is an elevation schematic view of a fuel stack assembly of the heater of FIG. 1.
Figure 4:
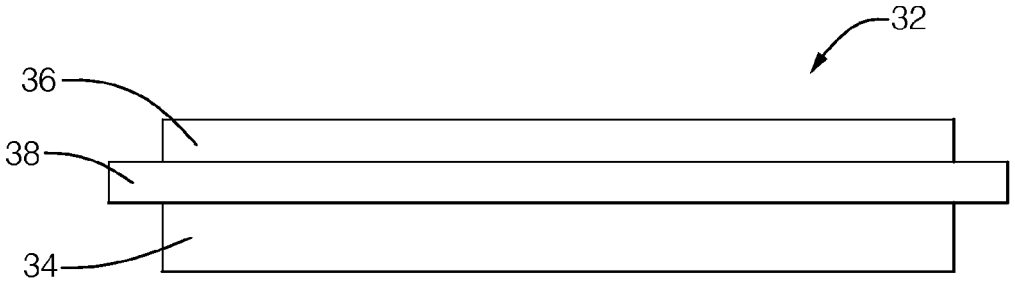
FIG. 4 is an elevation schematic view of a fuel cell of the fuel cell stack assembly of FIG. 3.

With continued reference to FIGS. 1 and 2 and now with additional reference to FIGS. 3 and 4, fuel cell stack assemblies 20 may be, for example only, solid oxide fuel cells which generally include a fuel cell manifold 28 and a plurality of fuel cell cassettes 30 (for clarity, only select fuel cell cassettes 30 have been labeled). Each fuel cell stack assembly 20 may include, for example only, 20 to 50 fuel cell cassettes 30.

Each fuel cell cassette 30 includes a fuel cell 32 having an anode 34 and a cathode 36 separated by a ceramic electrolyte 38. Each fuel cell 32 converts chemical energy from a fuel supplied to anode 34 into heat and electricity through a chemical reaction with air supplied to cathode 36. Fuel cell cassettes 30 have no electrochemical activity below a first temperature, for example, about 500° C., and consequently will not produce heat and electricity below the first temperature. Fuel cell cassettes 30 have a very limited electrochemical activity between the first temperature and a second temperature; for example, between about 500° C. and about 700° C., and consequently produce limited heat and electricity between the first temperature and the second temperature, for example only, about 0.01 kW to about 3.0 kW of heat (due to the fuel self-igniting above about 600° C.) and about 0.01 kW to about 0.5 kW electricity for a fuel cell stack assembly having thirty fuel cell cassettes 30. When fuel cell cassettes 30 are elevated above the second temperature, for example, about 700° C. which is considered to be the active temperature, fuel cell cassettes 30 are considered to be active and produce desired amounts of heat and electricity, for example only, about 0.5 kW to about 3.0 kW of heat and about 1.0 kW to about 1.5 kW electricity for a fuel cell stack assembly having thirty fuel cell cassettes 30. Further features of fuel cell cassettes 30 and fuel cells 32 are disclosed in United States Patent Application Publication No. US 2012/0094201 to Haltiner, Jr. et al. which is incorporated herein by reference in its entirety.

Fuel cell manifold 28 receives fuel, e.g. a hydrogen rich reformate, which may be supplied from a fuel reformer 40, through fuel supply conduit 22 and distributes the fuel to each fuel cell cassette 30. Fuel cell manifold 28 also receives an oxidizing agent, for example, air from an air supply 42, through air supply conduit 24 and distributes the air to each fuel cell cassette 30. Fuel cell manifold 28 also receives anode exhaust, i.e. spent fuel and excess fuel from fuel cells 32 which may comprise $H_2$, CO, $H_2O$, $CO_2$, and $N_2$, and cathode exhaust, i.e. spent air and excess air from fuel cells 32 which may comprise $O_2$ (depleted compared to the air supplied through air supply conduit 24) and $N_2$. Anode exhaust from fuel cell stack assemblies 20 is sent to anode exhaust return conduit 26 while cathode exhaust from fuel cell stack assemblies 20 is discharged into heater housing 18. Anode exhaust return conduit 26 communicates the anode exhaust out of heaters 10, e.g. out of bore hole 14, where the anode exhaust may be utilized by an anode exhaust utilization device 43 which may be used, for example only, to produce steam, drive compressors, or supply a fuel reformer. In order to estimate the thermal output of fuel cell stack assemblies 20, the anode exhaust communicated through anode exhaust return conduit 26 may be analyzed. Furthermore, the thermal output of fuel cell stack assemblies 20 may be adjusted by modulating the cathode flow or by adjusting the composition of the reformate. For example, methane may be added to the reformate which causes internal reforming within fuel cell stack assemblies 20. The internal reforming uses heat, thereby decreasing the thermal output of fuel cell stack assemblies 20.

Figure 5:
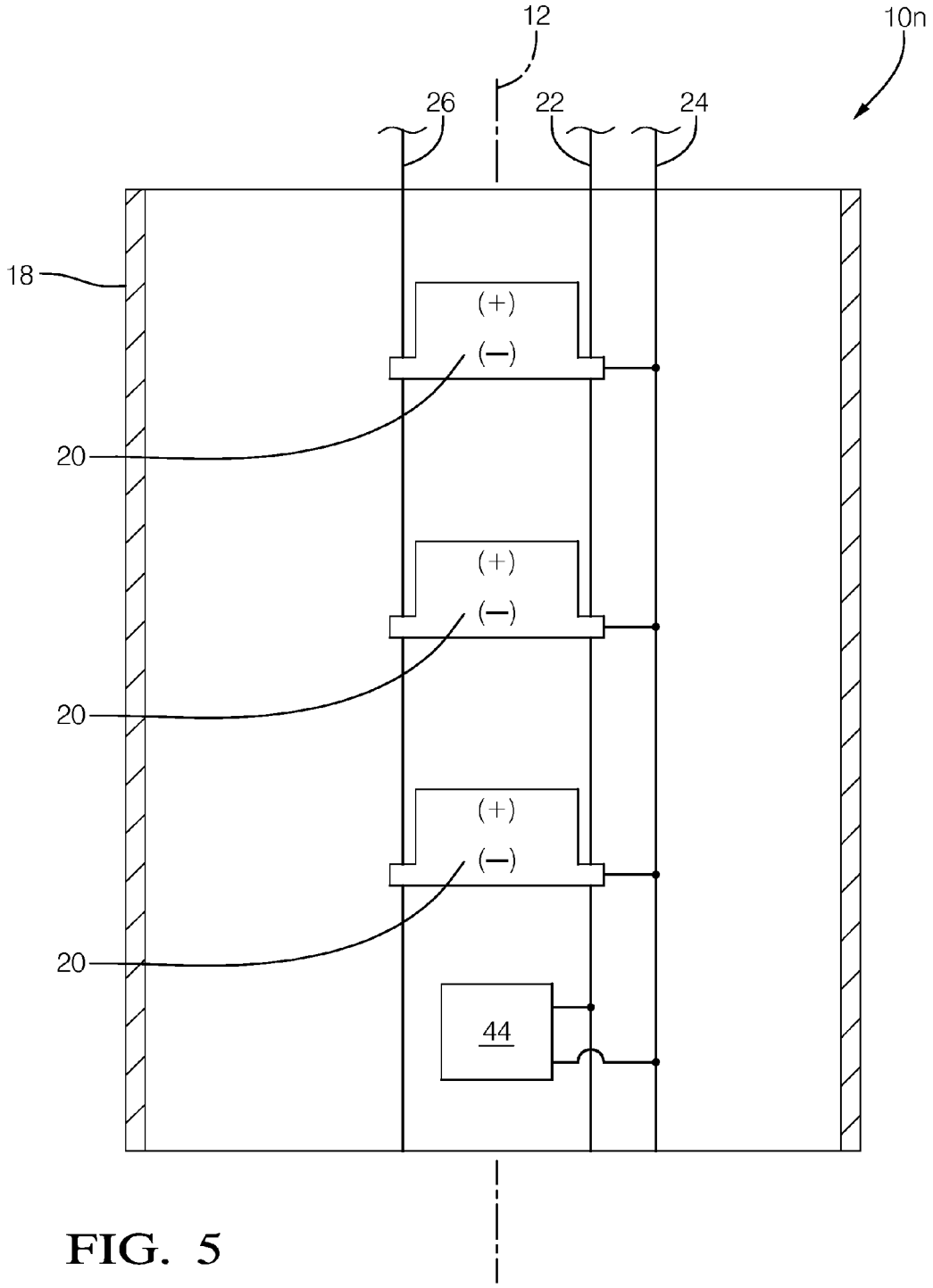
FIG. 5 a is cross-section schematic view of a heater which is positioned proximal to the bottom of the bore hole of FIG. 2 and which includes a supplemental heater that utilizes fuel bound energy.

Reference will again be made to FIGS. 1 and 2 and additional reference will now be made to FIGS. 5 and 6. In use, heaters $\mathbf{10}_1, \mathbf{10}_2, \ldots \mathbf{10}_{n-1}, \mathbf{10}_n$ are operated by supplying fuel and air to fuel cell stack assemblies 20 which are located within heater housing 18. Fuel cell stack assemblies 20 carry out a chemical reaction between the fuel and air, causing fuel cell stack assemblies 20 to be elevated in temperature, for example, about 600° C. to about 900° C. As a result, heat is transferred from fuel cell stack assemblies 20 to formation 16, thereby elevating the temperature of formation 16. In this way, fuel cell stack assemblies 20 are exposed to a heat loss. If the heat loss is too great, fuel cell stack assemblies 20 will operate at too low of a temperature which may be unfavorable to operability and durability of fuel cell stack assemblies 20. Heat loss in fuel cell stack assemblies 20 of heaters $\mathbf{10}_1$, $\mathbf{10}_2, \ldots \mathbf{10}_{n-1}$ is less severe because each fuel cell stack assembly 20 of $\mathbf{10}_1, \mathbf{10}_2, \ldots \mathbf{10}_{n-1}$ receives heat from fuel cell stack assemblies 20 that are lower in bore hole 14 since heat from lower fuel cell stack assemblies 20 tends to naturally rise through bore hole 14. However, fuel cell stack assemblies 20 of heater $\mathbf{10}_n$ do not receive additional heat from other fuel cell stack assemblies 20 since heater $\mathbf{10}_n$ is the lower-most heater 10 in bore hole 14. In order to overcome the additional heat loss experienced by fuel cell stack assemblies 20 of heater $\mathbf{10}_n$, a supplemental heater 44 (FIG. 5), 44' (FIG. 6) is provided to add heat to fuel cell stack assemblies 20 of heater $\mathbf{10}_n$. Heat from supplemental heater 44 may be transferred to fuel cell stack assemblies 20 of heater $\mathbf{10}_n$, for example only, by radiation or convection. As shown, supplemental heater 44 may be preferably located within heater housing 18 of heater $\mathbf{10}_n$, however, it should now be understood that supplemental heater 44 may be located outside of heater housing 18 of heater $\mathbf{10}_n$. Also as shown, supplemental heater 44 may be preferably located below heater $\mathbf{10}_n$, however, it should now be understood that supplemental heater 44 may be posited otherwise.

Supplemental heaters 44, 44' may utilize electrical or fuel bound energy or a combination of both. As shown in FIG. 5, supplemental heater 44 utilizes fuel found energy and receives fuel and air through fuel supply conduit 22 and air supply conduit 24 respectively. While not shown, it should now be understood that supplemental heater 44 could also utilized distinct air and/or fuel supply conduits that are not utilized by fuel cell stack assemblies 20. Supplemental heater 44 may be, for example only, a combustor which combusts the supplied fuel and air, thereby producing heat to prevent the temperature of fuel cell stack assemblies 20 of heater $\mathbf{10}_n$ from falling below a predetermined temperature, i.e. a temperature that would be undesirable for the operation of fuel cell stack assemblies 20 of heater $\mathbf{10}_n$. For example only, the predetermined temperature may be about 680° C. In order to effectively transport the heat from supplemental heater 44 to fuel cell stack assemblies 20 of heater $\mathbf{10}_n$, the flow rate of the air and fuel supplied to supplemental heater 44 may be about ten to about fifty times the flow rate of the air and fuel supplied to each individual fuel cell stack assembly 20. In this way, heater $\mathbf{10}_n$ has a thermal output that is greater than any other heater $\mathbf{10}_1, \mathbf{10}_2, \ldots \mathbf{10}_{n-1}$. The thermal output of supplemental heater 44 when using fuel bound energy may be controlled by varying the flow rate of fuel supplied to supplemental heater 44.

Figure 6:
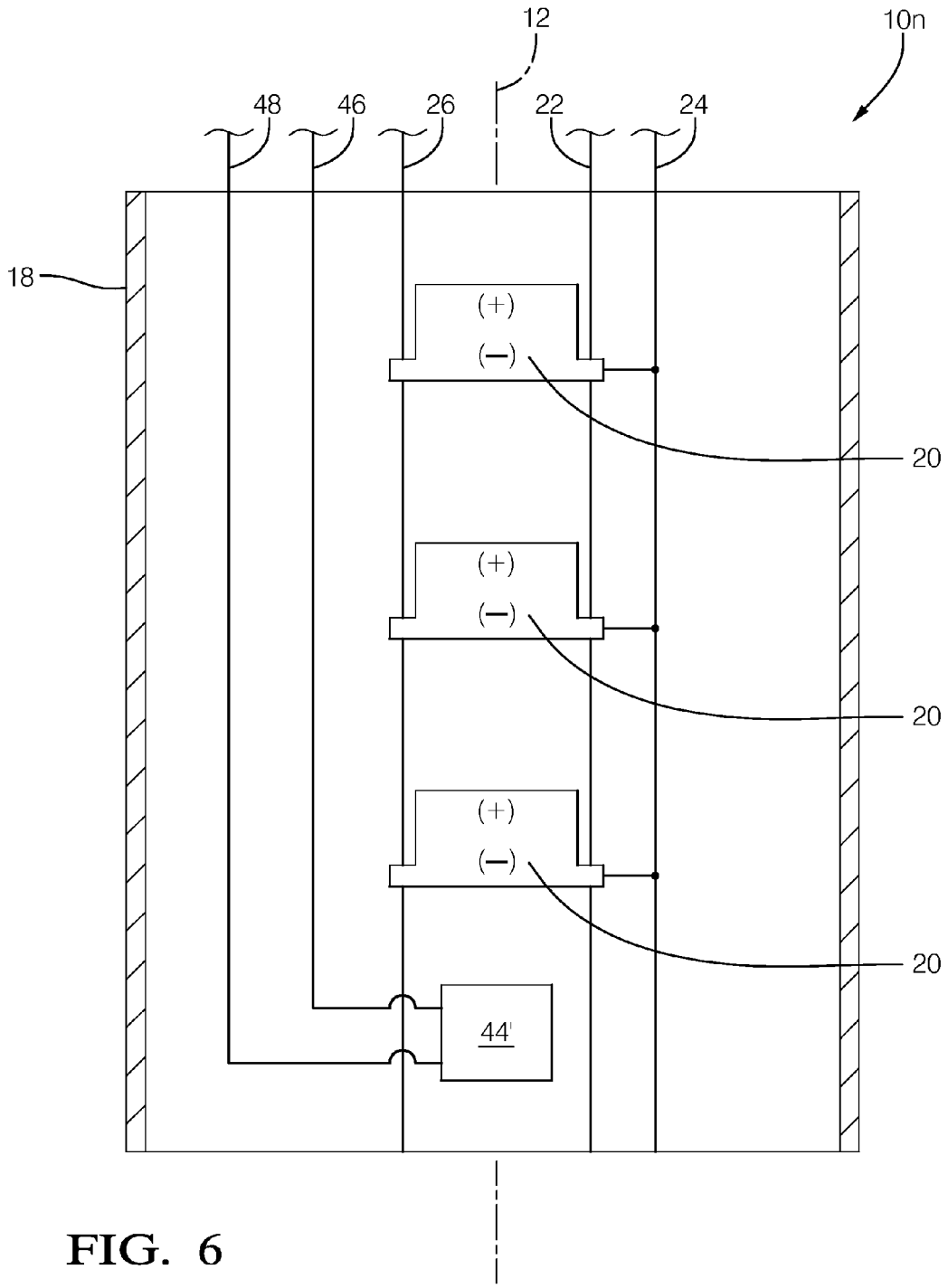
FIG. 6 a is cross-section schematic view of a heater which is positioned proximal to the bottom of the bore hole of FIG. 2 and which includes a supplemental heater that utilizes electrical energy.

Alternatively, as shown in FIG. 6, supplemental heater 44' utilizes electrical energy supplied through electric leads 46, 48 which are connected to an electricity source 50 (shown in phantom lines in FIG. 2) which may be, for example only, a utility grid, generator, or fuel cell. Supplemental heater 44' may be, for example only, an electric resistive heating element which uses the electricity by passing the electricity therethrough, thereby producing heat to prevent the temperature of fuel cell stack assemblies 20 of heater $\mathbf{10}_n$ from falling below the predetermined temperature. In this way, heater $\mathbf{10}_n$ has a thermal output that is greater than any other heater $\mathbf{10}_1$, $\mathbf{10}_2, \ldots \mathbf{10}_{n-1}$. The thermal output of supplemental heater 44' when using electricity may be controlled by varying the voltage and current applied to supplemental heater 44'.

While supplemental heaters 44, 44' have been described as being used during operation of fuel cell stack assemblies 20 of heater $\mathbf{10}_n$, it should now be understood that supplemental heaters 44, 44' may be operated in order to elevate fuel cell stack assemblies 20 of heater $\mathbf{10}_n$ to the active temperature when heater $\mathbf{10}_n$ is being started.

While this invention has been described in terms of preferred embodiments thereof, it is not intended to be so limited, but rather only to the extent set forth in the claims that follow.

We claim:

1. A plurality of heaters to be disposed end to end within a bore hole of a formation, said bore hole extending from an upper end to a lower end such that a lower heater of said plurality of heaters is proximal to said lower end of said bore hole while every other of said plurality of heaters is distal from said lower end of said bore hole, each of said plurality of heaters comprising:

a fuel cell stack assembly having a plurality of fuel cells which convert chemical energy from a fuel into heat and electricity through a chemical reaction with an oxidizing agent;

wherein each one of said every other of said plurality of heaters has a thermal output that is less than or equal to a predetermined value; and wherein said lower heater of said plurality of heaters has a thermal output that is greater than said predetermined value.

2. A plurality of heaters as in claim 1 wherein:

said lower heater of said plurality of heaters is exposed to heat loss that exceeds heat loss of each one of said every other of said plurality of heaters; and said lower heater of said plurality of heaters further comprises a supplemental heater which produces heat to prevent the temperature of said fuel cell stack assembly of said lower heater of said plurality of heaters from falling below a predetermined temperature in use.

3. A plurality of heaters as in claim 2 wherein said supplemental heater is a combustor.

4. A plurality of heaters as in claim 2 wherein said supplemental heater is an electric resistive heating element.

5. A plurality of heaters to be disposed end to end within a bore hole of a formation, said bore hole extending from an upper end to a lower end such that a lower heater of said plurality of heaters is proximal to said lower end of said bore hole while every other of said plurality of heaters is distal from said lower end of said bore hole, each of said plurality of heaters comprising:

a fuel cell stack assembly having a plurality of fuel cells which convert chemical energy from a fuel into heat and electricity through a chemical reaction with an oxidizing agent;

wherein said lower heater of said plurality of heaters is exposed to heat loss that exceeds heat loss of each one of said every other of said plurality of heaters; and wherein a supplemental heater is provided which produces heat to prevent the temperature of said fuel cell stack assembly of said lower heater of said plurality of heaters from falling below a predetermined temperature in use.

6. A plurality of heaters as in claim 5 wherein said supplemental heater is a combustor.

7. A plurality of heaters as in claim 5 wherein said supplemental heater is an electric resistive heating element.

8. A method of operating a plurality of heaters to be disposed end to end within a bore hole of a formation, said bore hole extending from an upper end to a lower end such that a lower heater of said plurality of heaters is proximal to said lower end of said bore hole while every other of said plurality of heaters is distal from said lower end of said bore hole, each of said plurality of heaters comprising a fuel cell stack assembly having a plurality of fuel cells which convert chemical energy from a fuel into heat and electricity through a chemical reaction with an oxidizing agent; said method comprising:

operating said lower heater to produce a thermal output that is greater than said every other of said plurality of heaters.

9. A method as in claim 8 where said lower heater of said plurality of heaters is exposed to heat loss that exceeds heat loss of each one of said every other of said plurality of heaters; said method further comprising:

providing said lower heater of said plurality of heaters with a supplemental heater; and using said supplemental heater to produce heat to prevent the temperature of said fuel cell stack assembly of said lower heater of said plurality of heaters from falling below a predetermined temperature.

* * * * *